United States Patent [19]

Landsborough

[11] 4,154,439

[45] May 15, 1979

[54] MAZE APPARATUS

[75] Inventor: Stuart Landsborough, Wanaka, New Zealand

[73] Assignee: Maze America, Inc., Pigeon Forge, Tenn.

[21] Appl. No.: 743,124

[22] Filed: Nov. 19, 1976

[51] Int. Cl.[2] ..... A63J 11/00

[52] U.S. Cl. ..... 272/19

[58] Field of Search ..... 272/2, 3, 19

[56] References Cited

U.S. PATENT DOCUMENTS

| | | | |
|---|---|---|---|
| 496,604 | 5/1893 | Guth | 272/19 |
| 760,032 | 5/1904 | Snedeker | 272/19 |
| 2,323,291 | 7/1943 | Bens | 272/19 X |

FOREIGN PATENT DOCUMENTS

| | | | |
|---|---|---|---|
| 59759 | 11/1891 | Fed. Rep. of Germany | 272/19 |
| 446879 | 10/1912 | France | 272/19 |
| 1027847 | 2/1953 | France | 272/19 |
| 13947 of | 1889 | United Kingdom | 272/19 |
| 247054 | 2/1926 | United Kingdom | 272/19 |

OTHER PUBLICATIONS

Rosamund's Bower, a maze from Maze and Lahyrinths by Walter Shepherd, Dover Publications, N.Y., N.Y. 1961.

*Primary Examiner*—Richard C. Pinkham
*Assistant Examiner*—Arnold W. Kramer
*Attorney, Agent, or Firm*—Pitts, Kressin & Kesterson

[57] ABSTRACT

A maze apparatus adapted for use as a walk-through recreational facility. The apparatus includes a supporting surface carrying a plurality of substantially upright partitions which serve to define the maze course having a plurality of interconnected pathways along which movement of persons through the maze is restricted. Persons enter the course through an entrance opening into one of the pathways and progress along a bewildering array of interconnected pathways to gain egress from the apparatus course through a suitable exit. The partition panels can readily be rearranged for rescheduling the maze course which includes a predetermined shortest route having vital sections which must be traversed in order to reach the exit.

1 Claim, 5 Drawing Figures

MAZE APPARATUS

Figure 1:
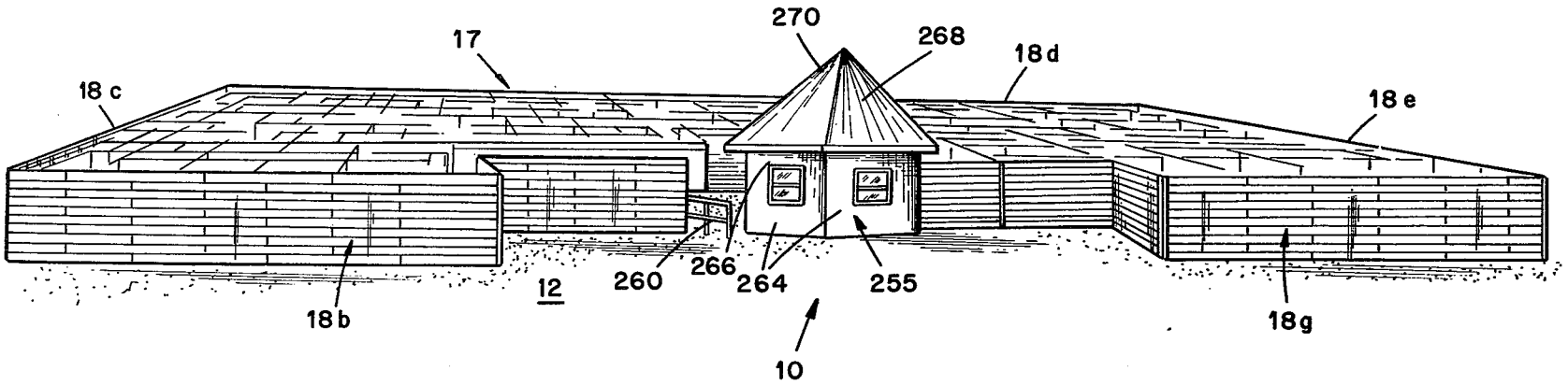

This invention relates to maze apparatus and more particularly concerns a walk-through maze for use as a recreational facility.

Mazes or labyrinths have been in existence for thousands of years and are thought to have originated as a means to discourage or mislead intruders into tombs or locations containing treasures. A number of extensive architectural mazes were famous in the ancient world. One of the most celebrated in story and Greek mythology was a huge labyrinth in Crete. This was the palace of Minos and comprised an intricate plan of long corridors, successions of blind galleries, tortuous passages and a bewildering arrangement of rooms. Another ancient idea of the labyrinth was used as a prison without doors from which escape was nearly impossible. Such a labyrinth was adapted by the Medieval Church to provide a path for the Pilgrims to follow on hands and knees by way of penance.

In England, the old mazes were used more for outdoor amusement and included walls of vegetation such as hedges. The garden mazes may have been copied from the Romans and became the fashion in Italy, France, Holland and England during the Sixteenth Century. One example of a famous English garden maze is the Hampton Court Maze which was built in 1606 during the reign of William, III.

Certain maze designs are also common in North America, for example, in the Northeastern Arizona area, mazes were carved on rocks by the Hopi Indians. According to the Hopis, the maze design represented the myth of emergence and is called the Mother Earth symbol. The pathways in the Hopi mazes are paths that one must follow on his road to life. The Pima Indians in Southern Arizona still use this design on their baskets. The maze motif spread rapidly among the Indians in the Eighteenth Century and was a favorite design used on pottery by the Cherokees in North Carolina and Tennessee.

While maze designs of various types have been known for thousands of years, various subtleties must be taken into account when designing a walk-through maze for use as a commercial recreational facility. For example, it is necessary in a commercial maze to present a course which is simple enough not to frustrate the patrons, yet challenging enough to give the patrons a feeling of accomplishment upon reaching the exit. In this connection, it has been found that a maze having an average course transition time of from 20 to 25 minutes results in less than about twenty percent of the patrons soliciting aid to reach the end while the majority pass through the maze with a feeling of satisfaction.

It is also desirable in commercial maze construction to provide an apparatus which can readily be rescheduled to alter the maze course for providing new and different challenges to repeating customers. Moreover, in a commercial application, it is desirable to construct a maze apparatus which includes a course which is designed to enhance the mobility of patrons moving through the maze.

Figure 2A:
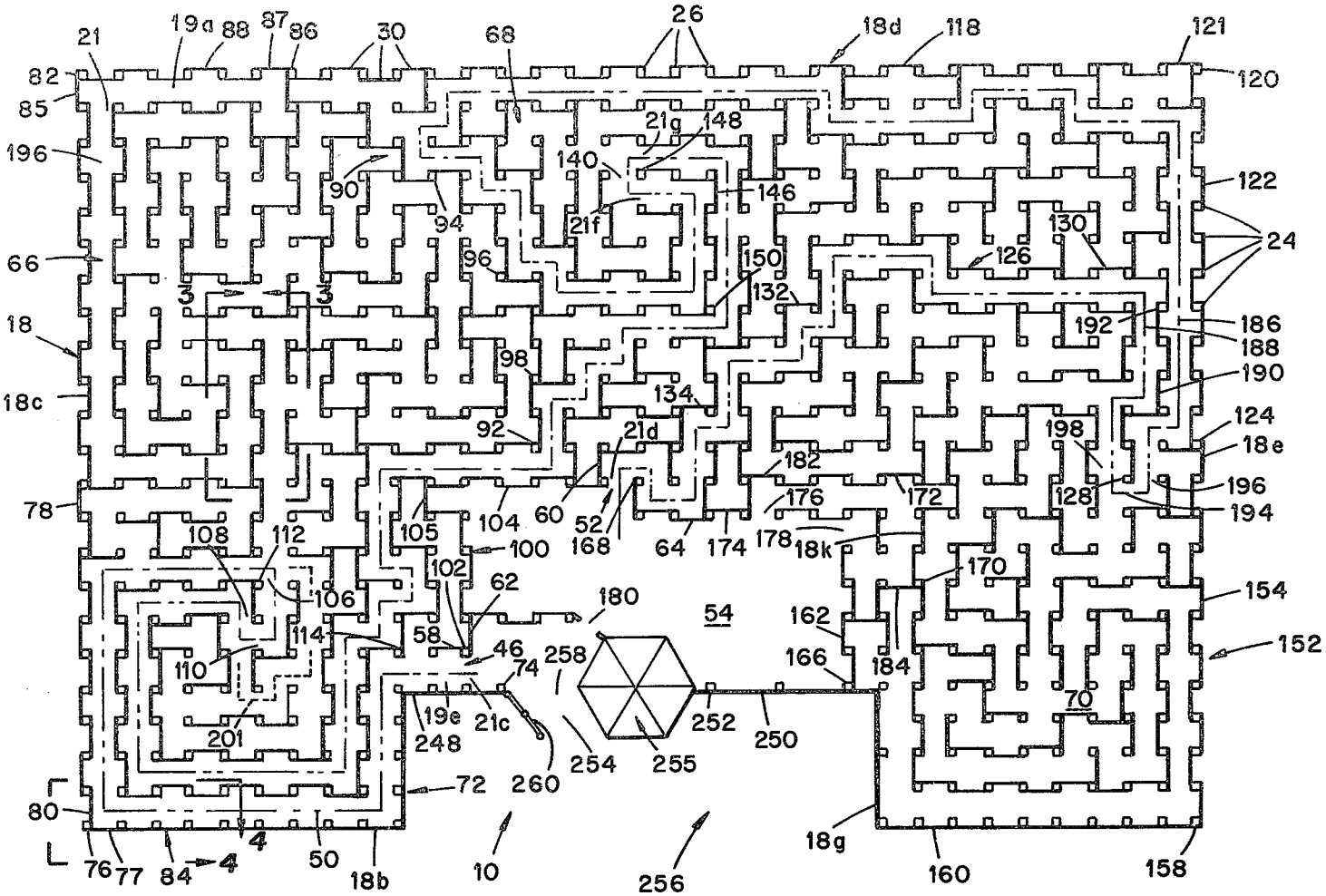
Figure 2B:
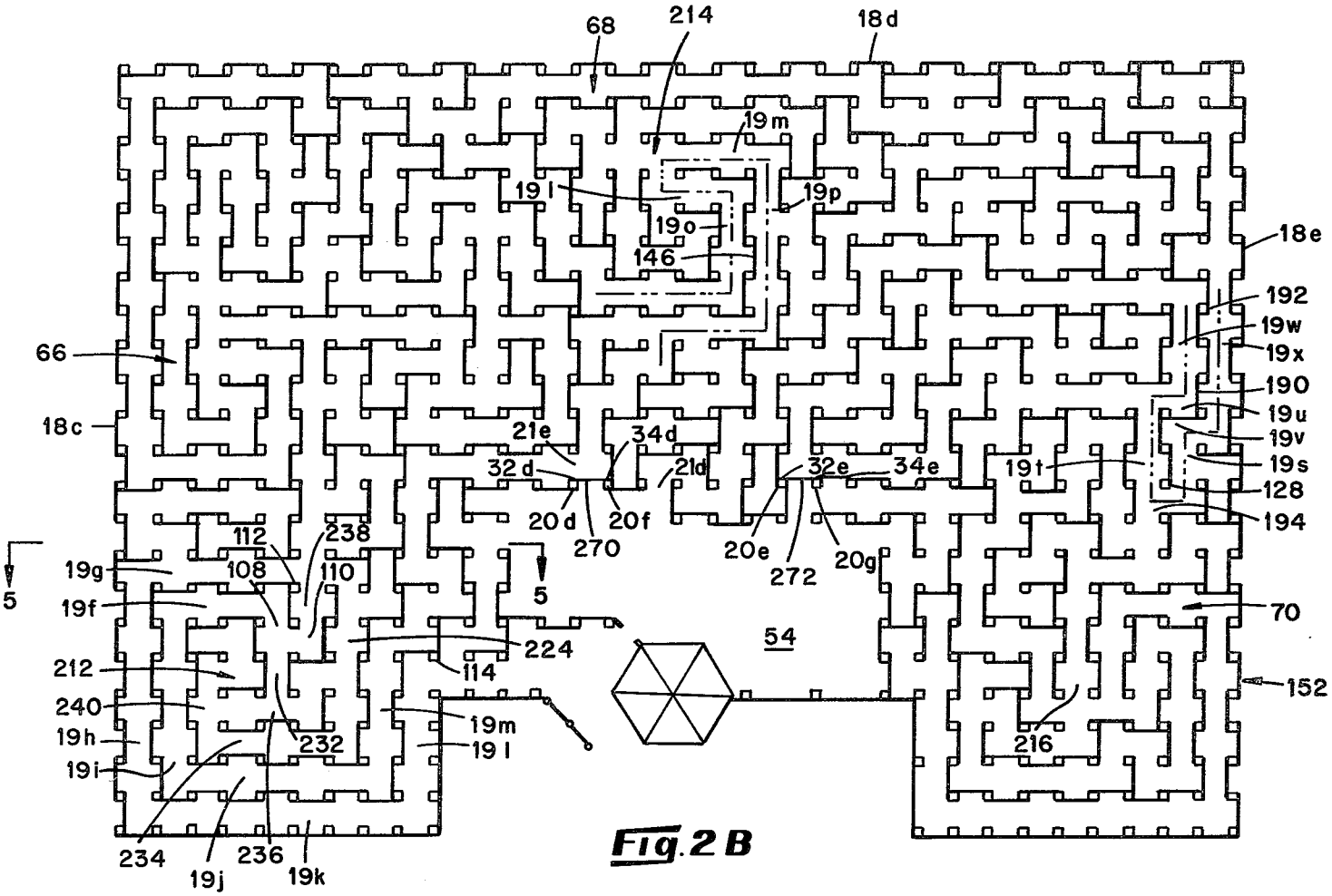
Figure 3:
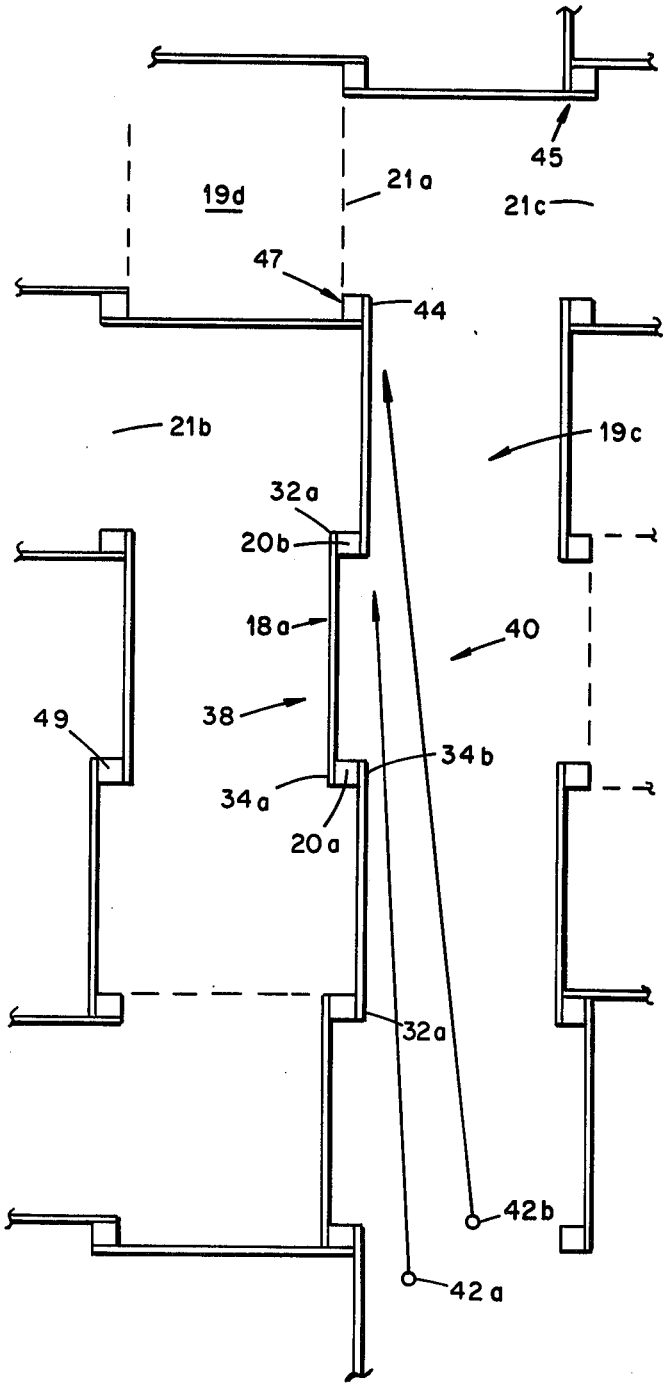
Figure 4:
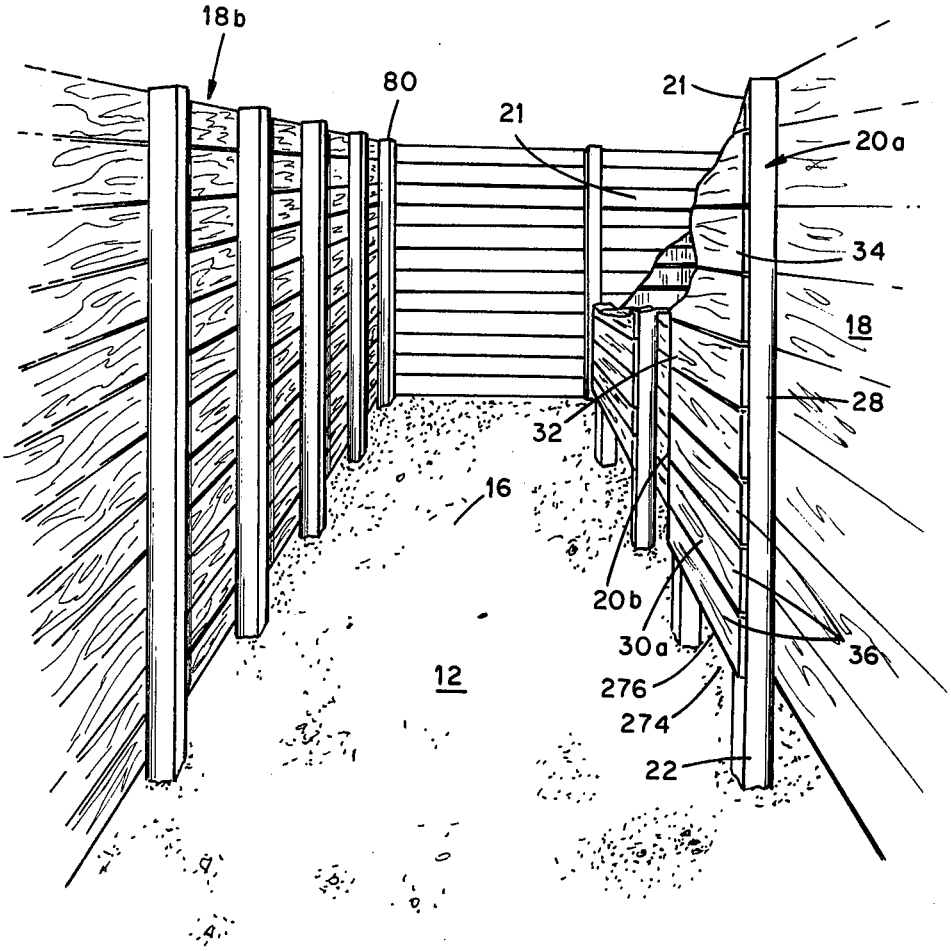

It is therefore an object of this invention to provide an improved maze apparatus. Another object of this invention is to provide a walk-through maze apparatus which can be readily rescheduled for altering the maze course. It is a further object of the invention to provide a reference visible from each of the pathways of the course. Other objects and advantages of the present invention will become apparent upon reading the detailed specification together with the drawings wherein:

FIG. 1 is a perspective view of a maze apparatus constructed in accordance with various features of the invention;

FIGS. 2A–B are plan views of the apparatus shown in FIG. 1;

FIG. 3 is an enlarged plan view of a section of the apparatus taken along line 3—3 of FIG. 2A; and FIG. 4 is a perspective view of a section of a pathway and associated partitions taken along line 4—4 of FIG. 2A.

A maze apparatus is provided in accordance with various features of the invention which includes a supporting surface over which movement of persons is restricted by a plurality of substantially upright partitions which serve to define the maze course having a plurality of interconnected pathways. Persons gain admission into the maze apparatus through a suitable entrance opening into at least one of the pathways and proceed along a tortuous route towards an exit. In order to reach the exit, it is necessary to follow along lengths of predetermined vital sections of a shortest route. Panel portions of the partitions can be rearranged as necessary or desired to reschedule the maze course to provide new challenges for repeating customers, for example. In one embodiment of the invention, a reference point which is visible from each of the pathways is provided. To enhance the mobility of persons within the maze course, round-abouts are provided in one embodiment and serve to direct persons following certain of the interconnected pathways of the round-about into the same location from various directions.

Referring now to the drawings, and specifically to FIG. 1, a maze apparatus 10 embodying various features of the invention is illustrated. The illustrated maze apparatus 10 is adapted for guiding persons along a course of interconnected tortuous pathways and finds particular application as a recreational facility. The maze apparatus 10 illustrated in the drawings is an outdoor facility, however, as necessary or desired, the apparatus may be constructed indoors for year round use in a controlled environment, for example.

The maze apparatus 10 includes a suitable supporting surface 12 which serves to support persons moving through the apparatus. The illustrated supporting surface 12 is substantially planar and comprises the ground covered with a layer of gravel 16 which assists in providing a suitable walking surface particularly in wet weather. As necessary or desired, the supporting surface 12 may be multilevel and interconnected by stairs or sloped surfaces to increase the bewildering effect of the maze course. Moreover, the surface may be sloped to assist in draining water from the course location in areas having substantial rainfall.

Movement of persons through the maze apparatus 10 is restricted to a course 17 of interconnected pathways 19 defined by partitions 18 and interconnected by passages 21 (See FIG. 2A). The illustrated partitions 18 which serve to define the pathways 19 include a plurality of substantially upright members or posts 20 which are supported at their respective lower ends 22 by the ground and gravel 16. The posts 20 are fabricated from a suitable rigid material such as wood, metal or the like and are preferably of sufficient lengths, 8 to 10 feet, for example, so that the portion 28 (see FIG. 4) of the post 20 disposed above the ground is of adequate length to prevent an adult from being able to view over the post and see the remainder of the maze course. In this connection, it has been found desirable for portion 28 of the post to be approximately 6 to 7 feet in length. By burying approximately 2 feet of the posts in the ground in certain areas, adequate support for the partitions is provided.

These posts 20 are arranged in grid pattern of aligned rows 24 and columns 26 with each of the posts being spaced substantially equal distance from adjacent posts in their respective row and column.

Preselected posts 20*a* and 20*b*, for example, (see FIG. 4), are interconnected by panels 30 which serve to restrict movement of persons along predetermined pathways 19 which collectively define the maze course 17. More specifically, the illustrated panels 30 are substantially identical in size and fabricated from a suitable rigid material such as wood. Each of the panels include substantially upright marginal edges 32 and 34 which are secured to preselected adjacent posts disposed in an aligned row or column. These pannels serve to span the distance between preselected adjacent posts and cooperate with further partitions and panels to define the pathways 19. Moreover, the upper edges 21 of respective panels are disposed at a height above the surface 12 to prevent persons walking through the maze course 17 from viewing over the panels 30 and seeing the remainder of the course to determine a desirable route. In this connection, the upper edges of the panels 30 are secured proximate the top edge of adjacent supporting posts, 20*a* and 20*b*, for example, in FIG. 4.

In the illustrated embodiment, the panels 30 comprise a plurality of horizontally aligned boards 36 of substantially identical length which span the distance between preselected adjacent posts 20*a* and 20*b*, for example in a row or column. These panel boards 36 are releasably secured at their opposite ends to the posts 20*a* and 20*b*, respectively, to the end that the boards can be readily removed for rescheduling the maze course as discussed in greater detail hereinafter.

In order to assist in preventing persons moving through the maze course 17 from recognizing locations along the length of the partitions 18 which serve to define the pathways, the opposite surfaces 38 and 40 of the partitions 18 (see FIG. 3) are substantially identical in appearance. To this end, the panels 30 are staggered along the partition lengths and secured along their upright marginal edges 34*a* and 34*b*, for example, at annularly spaced locations on each of the posts 20. It will be noted that the panel edges are secured on opposite sides of a post, i.e., approximately 180° apart, where adjacent panels form a substantially straight length of partition. These staggered panels 30 serve to require further exploration of the pathways 19 in order to locate the passages 21 leading into an adjoining pathway. For example, a person standing at locations 42*a* and 42*b* in FIG. 3 is unable to see the passage 21*a* at the end 44 of the pathway 19*c* and must therefore explore a greater length of the pathway 19*c* in order to discern the presence of this passage 21*a*.

In a commercial maze apparatus, it is desirable that the pathways 19 are readily reschedulable to alter the course pattern and present a new challenge for repeating customers. To this end, the staggered panels 30 illustrated in FIGS. 2A–B and 3 are releasably secured along their marginal edges 32 and 34 and can be moved to preselected adjacent posts 20 in a row 24 or column 26 by reason of the substantially identical spacing between adjacent posts in each of the rows and columns and of the substantially identical proportions, particularly the width dimension, of the panels 30. More specifically, the marginal edges 32 and 34 of each of the panels are secured at annularly spaced locations about the perimeter of each post carrying more than one panel edge as indicated at 45, 47 and 49, for example, in FIG. 3. By reason of such annular spacing of the marginal edges of panels secuured to a single post, each post 20 is capable of supporting the marginal edges of up to four panels. In this connection, preselected portions of the maze course are alterable without varying the entire maze course to the end that the maze course difficulty can readily be tailored to the sophistication of special groups as necessary or desired.

In the illustrated embodiment, ingress into the maze course is gained through a suitable entrance 46 comprising passage 21*c* opening into pathway 19*e* and continuing along a shortest route indicated by a line 50 through the maze course to an exit 52 which opens into a garden court area 54. As necessary or desired, passages 21*c* and 21*d* which serve as the entrance and exit, respectively, may be altered for rescheduling the maze. For example, panels 58 and 60 can be placed across the entrance 46 and exit 52, respectively, and further panels, such as the panels 62 and 64 may be removed to provide a new entrance and exit.

The illustrated maze course 17 is divided into a plurality of sections 66, 68 and 70 which function as substantially independent maze courses. Each of the sections are joined by a respective vital section of the shortest route 50 which must be traversed by one progressing through the maze from the entrance 46 to the exit 52. More specifically, section 66 of the course is bordered by the Z-shaped length 72 of the front partition 18*b* which extends between 74 and 76 and which is joined at its end 77 with end 80 of the substantially straight length 78 of side partition 18*c* extending between 76 and corner 82 and which is disposed substantially perpendicularly with respect to section 84 of the front partition 18*b*. End 85 of side partition 18*c* is joined with a substantially straight partition 18*d* which extends, in part between 82 and 86 to define the rear boundry of section 66 of the course. End 87 of the section 88, of the partition 18*d*, which joins 82 and 86, is joined with a continuous, tortuous length 90 of partition extending between 86 and 92 and passing through 94, 96 and 98. This tortuous length of partition 90 serves to separate sections 66 and 68 of the maze course 17 with the remaining portion of section 66 being closed by the tortuous partition length 100 extending between 102 and 104 and passing through 105.

In order to progress from section 66 to section 68 of the course, vital pathways or sections of the shortest route 50 must be traversed. It will be recognized from FIGS. 2 and 2A that there is not alternate route for entering section 68 of the maze course 17 from section 66 except by passing through passages 106 and 108 adjacent the location indicated at 110 comprising a vital juncture. Vital sections of the shortest route 50 through section 66 includes pathways 19*f*, 19*g*; 19*h*, 19*i*; 19*j*, 19*k*; and 191, 19*m* which are separated by a common length of partition, i.e., extending between 112 and 114. In this connection, a person must move in opposite directions on opposite sides of the partition length extending between 112 and 114 to progress through the maze course. It has been found that by interconnecting the sections 66 and 68 by pathways separated by a common length of partition and which must be travelled in opposite directions, persons normally first opt for a route other than the shortest route connecting the passages 106 and 108 thus deviating from the necessary or vital route necessary to progress through the maze. It will be recognized however, that upon passing through passage 108 into the pathway 19*f*, no further options are presented until section 68 of the course is entered through passage 21*e*. In this connection, after passing through the vital juncture 110 interconnecting passages 106 and 108, a person is directed into section 68 of the maze course.

Section 68 of the maze course 17 is bordered by the tortuous partitions length 90 extending between 86 and 92 and which is joined at end 86 with the substantially straight length 118 of partition 18*d* comprising a section of the rearward wall of the maze course. This section 118 is joined at end 120 with the partition length 122 extending between end 120 and 124 to form the side partition 18*e* of section 68 of the course 17. The forward partition of section 68 of the maze course comprises the tortuous and continuous length 126 of partition extending between 128 and 104 and passing through 130, 132 and 134.

In order to progress from section 68 to section 70 of the maze course, vital sections of the shortest route 50 including the passages 21*f* and 21*g* comprising a vital junction 140 which must be traversed. It will be recognized from FIG. 2A that there is no alternate route for entering section 70 of the maze course from section 68 except through these vital passages 21*f* and 21*g*. This vital section of the shortest route 50 includes the pathways 191, 19*m*; and 19*o*, 19*p* which are separated by a common length 146 of partition extending between 148 and 150 to the end that persons progressing from section 68 of the maze course to section 70 of the maze course must move in opposite directions on opposite sides of the partition length 146.

Section 70 of the course is bordered on its side 152 by the substantially linear partition length 154 of the side partition 18*e* extending between 124 and 158, this end 158 of length 154 being joined with the Z-shaped front wall or partition 18*g*. The tortuous and continuous length 162 of partition extending between 166 and 168 and passing through the locations 170, 172 and 174 forms with partition 18*g* the forward wall of section 70 of the course 17 and terminates at the exit 52.

It will be recognized that bogus exits 176 and 178 are provided. These exits serve to misguide persons who may peer through the gate 180 as they enter the maze course at the entrance 46 in an attempt to discern the exit. Moreover, the bogus exits 176 and 178 serve to misguide persons who peer through any cracks or openings in the partitions, for example, at 182 and 184 in order to discern the exit location and gain an advantage over their more forthright or less opportunistic fellow maze walkers.

In order to progress from section 68 to the exit 52, vital lengths of the shortest route 50 including the plurality of pathways interconnecting 186 and 188 must be traversed.

More specifically, it will be recognized from FIGS. 2A and 2B that there is no alternate route for reaching the exit 52 than by traversing the section of the shortest route 50 which includes pathways 19*s*, 19*t*; 19*u*, 19*v* and 19*w*, 19*x* which are separated by a common length 190 of partition extending between 128 and 192 to the end that persons progressing through section 70 of the course must reverse their direction at the vital juncture 194 interconnecting the passages 196 and 198 or more generally move in opposite directions along pathways 19*o*–*x* separated by the common length of partition 190.

It will be recognized that at each of the vital junctures 110, 140 and 194 on the shortest route 50, the direction of a person moving through the maze course must be reversed in order to stay on the shortest route. Optional passages are presented to one moving through along the shortest route at each of the vital junctures 110, 140 and 194 which do not require reversing the direction of movement and it has been found that substantial numbers of persons taken such optional routes and travel through non-essential portions of the maze course 17. However, upon passing through the respective vital junctures, either by the most direct route, or a more indirect route, e.g., the indirect route 201 for vital juncture 110, substantial lengths of vital sections of the shortest route are presented without the presentation of further optional routes. This feature has significant commercial ramifications as will be pointed out in greater detail hereinafter.

In order to enhance the movement of persons within the maze course 17 while delaying the progress of the persons toward the exit 52, a plurality of spaced apart round-abouts generally indicated at 212, 214 and 216 are incorporated into the maze course. These round-abouts include a plurality of interconnected pathways which serve to define a substantially rectangular island having interlinked pathways which circumnavigate the island. Each of the round-abouts includes at least one location which is interlinked with a plurality of passageways, and disposed substantially centrally of the round-about to the end that a person can enter this preselected location from a variety of directions and thereby has difficulty in discerning that the same location is traversed or entered more than one time. More specifically, the portion of the maze course comprising round-about 212 is substantially rectangular in outline and includes a plurality of interlinked straight pathways 19*f*-*m* and 232–240 which substantially circumnavigate the island area indicated by line 5–5 (FIG. 2B). Ingress into and egress into and from the location indicated at 110 can be gained through a variety of pathways 232, 238 and 19*f*. In this connection, in attempting to exit the location 110 and proceed along the course toward the maze exit 52 along the shortest route 50, the likelihood of returning to this location 110 from another direction is increased and by reason of entering this location from a variety of directions, the likelihood of not recognizing the location 110 is substantially enhanced. It will be recognized that in the illustrated embodiment the location 110 serves a vital junction and that the passage 108 must be entered to move along the section of the shortest route 50 beginning at passage 108 and continuing to passage 21*e* which comprises a vital section or route, i.e., a length of the shortest route 50 which must be followed in order to reach the exit.

In one embodiment, the maze apparatus 10 is substantially horseshoe shaped and bordered along its sides by substantially parallel partitions 18*c* and 18*e* which are interconnected at their ends 82 and 120 by partition 18*d* which is disposed substantially perpendicularly to each of these partitions 18*c* and 18*e* and comprises the rear wall of the apparatus 10. The forward wall of the maze apparatus 10 comprise the partitions 18*b* and 18*g* and include the substantially colinear partition lengths, 248 and 250 which terminate at spaced ends 74 and 252 which define and opening 254 therebetween.

In order to provide the front 256 of the apparatus 10 in a smooth facade, the panels of the forward wall including partitions 18*c* and 18*g* are not staggered (see FIGS. 1, 2A–B and 4) and preferably are of greater length than the interior panels to enhance the smooth appearance of the front of the maze apparatus. As necessary or desired, however, the panels of the forward wall may be staggered about their supporting upright members.

A suitable building 255 or kiosk is interposed between ends 252 and 74 of the partitions 18*g* and 18*b*, respectively, and serves as ticket stand in the illustrated embodiment for collecting money and issuing tickets to patrons passing through gate 258 defined by the kiosk 255 and the handrail 260. Gate 258 also serves as an egress from the apparatus 10 upon completion of the maze course 17.

In the illustrated embodiment, the walls 264 of the building are substantially hexagonal in outline and closed along their upper portion 266 by a substantially conical roof 268. The uppermost portion 270 of the roof 268 is visible from each portion of the maze and serves as a reference for patrons moving through the maze pathways. More specifically, the reference portion 270 of the roof 268 serves to give the persons within the maze course illusions of being oriented. It has been found that this provision of maze pathways 18 which are open at their top portion and from which the reference portion 270 of the roof is visible serves to cause persons moving through the maze course to deviate from the shortest route 50 by creating a pattern or thought which either draws them toward the kiosk or causes them to move along pathways in an opposite direction.

A significant feature in designing a maze apparatus of the type disclosed for commercial purposes is to make the apparatus have an average transversal time within a preselected range. It has been found that if this average transversal time is approximately 20 to 25 minutes, few patrons become frustrated and solicit help in order to find the exit. Moreover, those patrons who successfully find the exit 52 enjoy a feeling of accomplishment. To this end, the shortest route 50 includes certain vital sections along which no optional passages leading from the chosen route are presented. It has been found that by providing sufficient choices at the vital junctions 110, 140 and 194, for example, few persons will walk directly through the maze course following along the shortest route 50, and will explore enough non-essential areas of the maze spaced from the shortest route to have a feeling of accomplishment upon ultimately finding the exit 52.

In order to assist patrons who become frustrated after failing to reach the exit 52 in exiting the apparatus 10, emergency exits 270 and 272 are hingedly connected along upright end margins 32*d* and 32*e* to posts 20*d* and 20*e*, respectively, and secured at their respective opposite end margins 34*d* and 34*e* to posts 20*f* and 20*g*, respectively, by a suitable latch or lock (not shown) which may be opened from the garden-court area 54 by a manager solicited by the patron.

It will be recognized that the illustrated maze course 17 may be expanded as necessary or desired by increasing the size of the rows and/or columns in the grid pattern of posts 20 and adding panels at preselected locations. To facilitate expansion in the illustrated embodiment, the partitions 18*c*, 18*d* and 18*e* which define sides and rearward wall of the course include staggered panels in the illustrated embodiment to minimize the amount of labor required to expand the maze course. As necessary or desired, however, the border partitions may be provided with a smooth surface finish such as illustrated by partitions 18*b* and 18*g*.

To enhance the circulation of air within the maze course, gaps 274 are left along the bottom length of each of the interior partitions 18 between the lower edges 276 of the panels 30 and the supporting surface 12 (See FIG. 4). These gaps 274 together with the passages 21 serve to enhance circulation of air within the maze course on hot days and to increase the commercial attraction of the apparatus. Moreover, these gaps also assist in preventing claustophobia. To this end, the gaps 274 in one embodiment are porportioned to allow an adult to crawl under the panels 30 into adjacent pathways if necessary or desired.

From the foregoing detailed description, it will be recognized that the illustrated maze operations embodies various features which particularly adapt the maze apparatus for usage as a commercial facility. For example, the illustrated maze apparatus includes partitions which restrict the movement of persons traversing the maze to predetermined pathways. The partitions are of a height sufficient to prevent an adult from viewing over the top of the partition and seeing the remainder of the maze course to determine his route and include staggered panels which present substantially uniform appearances along the length of their opposite surfaces or sides of the partition to assist in preventing patrons from recognizing a particular partition or side thereof. The staggered panel construction also serves to facilitate rescheduling the maze to provide a new challenge to repeating customers, for example.

While a preferred embodiment has been shown and described, it will be understood that there is no intention to limit the invention by such disclosure, but rather it is intended to cover all modifications and alternative constructions falling within the spirit and scope of the invention as defined in the appended claims and equivalents thereof.

What is claimed is:

1. A walk-through maze apparatus for use as a recreational facility, said apparatus including: a supporting surface, partition means supported in a substantially upright position on said supporting surface and serving to define a course having a plurality of interconnected pathways along which movement of persons through said maze is restricted, said partition means including a plurality of upright members positioned at predetermined spaced locations, a plurality of panel members interconnecting preselected adjacent upright members each of said panel members defining an upright edge disposed at a height to prevent an average adult from viewing over said partition means into adjacent pathways, adjacent panels along predetermined lengths of said partition means being staggered on opposite sides of said upright members whereby a person walking through said maze course is required to further explore the lengths of said pathways to determine passages leading into adjoining pathways.

* * * * *